US009572466B2

(12) United States Patent
De Wit et al.

(10) Patent No.: US 9,572,466 B2
(45) Date of Patent: Feb. 21, 2017

(54) NOZZLE FOR A VACUUM CLEANER

(71) Applicant: KONINKLIJKE PHILIPS N.V., Eindhoven (NL)

(72) Inventors: Bastiaan Johannes De Wit, Eindhoven (NL); Arnoldus Cornelis Wessels, Eindhoven (NL); Bastian Cornelis Kleine-Doepke, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/434,935

(22) PCT Filed: Sep. 28, 2014

(86) PCT No.: PCT/EP2014/070712
§ 371 (c)(1),
(2) Date: Apr. 10, 2015

(87) PCT Pub. No.: WO2015/044399
PCT Pub. Date: Apr. 2, 2015

(65) Prior Publication Data

US 2016/0296087 A1 Oct. 13, 2016

(30) Foreign Application Priority Data

Sep. 30, 2013 (EP) ..... 13186671

(51) Int. Cl.
*A47L 9/02* (2006.01)
*A47L 9/06* (2006.01)
*A47L 11/20* (2006.01)

(52) U.S. Cl.
CPC ..... *A47L 9/0653* (2013.01); *A47L 9/068* (2013.01); *A47L 9/0686* (2013.01); *A47L 11/20* (2013.01)

(58) Field of Classification Search
CPC ..... A47L 9/0653; A47L 9/0686; A47L 9/068; A47L 11/20
USPC ..... 15/416, 417
See application file for complete search history.

(56) References Cited

U.S. PATENT DOCUMENTS

| | | | |
|---|---|---|---|
| 2,319,927 | A | 9/1940 | Hansson |
| 2,838,783 | A | 6/1958 | Allen |
| 2,966,693 | A | 1/1961 | Anderson |
| 3,380,106 | A | 4/1968 | Decarries |
| 3,745,603 | A | 7/1973 | Bayless |

FOREIGN PATENT DOCUMENTS

| | | | |
|---|---|---|---|
| EP | 2103242 | A2 | 9/2009 |
| GB | 1116277 | A | 6/1966 |
| JP | 2001161603 | A | 6/2001 |

*Primary Examiner* — David Redding

(57) ABSTRACT

The present application relates to a nozzle for a vacuum cleaner. The nozzle comprises a body (2) and a base (3). The base (3) has a longitudinal axis, and at least two cleaning sides (17, 18) configured to act on a surface in respective cleaning conditions. The base (3) is rotatable around a rotational axis (A-A) that is parallel to the longitudinal axis of the base to move the base (3) between the respective cleaning conditions.

12 Claims, 10 Drawing Sheets

NOZZLE FOR A VACUUM CLEANER

This application is the U.S. National Phase application under 35 U.S.C. §371 of International Application No. PCT/EP2014/070712, filed on Sep. 28, 2014, which claims the benefit of European Application No. 13186671.7 filed on Sep. 30, 2013. These applications are hereby incorporated by reference herein.

FIELD OF THE INVENTION

The present invention relates to a nozzle for a vacuum cleaner.

BACKGROUND OF THE INVENTION

Vacuum cleaners clean surfaces using suction to collect dust and debris. A common type of vacuum cleaner generally comprises a motor that drives a fan to generate an air flow, and a collection vessel. A conduit fluidly communicates the collection vessel with a nozzle.

A nozzle for a vacuum cleaner is disclosed in U.S. Pat. No. 3,380,106 and comprises a housing and a conduit that is fluidly communicated with a vacuum cleaner. The housing has a portion for use on hard floors and a portion for use on soft floors. The housing is rotatable relative to the conduit to position one of the soft and hard floor portions against a surface to be cleaned.

U.S. Pat. No. 3,745,603 discloses a vacuum cleaner suction tool having a hollow body, the interior of which may be connected to a source of suction in a vacuum cleaner through an elbow which is rotatably mounted in the body. One face of the body is formed with an elongated suction opening. Depending from the opposite face of the body is a plurality of spaced relatively narrow nozzles. The elbow serves as a rotary valve to connect either the plurality of nozzles or the elongated suction opening to the interior of the elbow and hence to the source of suction.

SUMMARY OF THE INVENTION

It is an object of the invention to provide an alternative way to select a most appropriate cleaning condition for cleaning a surface. The invention is defined by the independent claims, while the dependent claims define advantageous embodiments.

According to one aspect of the present invention, there is provided a nozzle for a vacuum cleaner, the nozzle comprising a body and a base, the base having a longitudinal axis, and at least two cleaning sides configured to act on a surface in respective cleaning conditions, wherein the base is rotatable around a rotational axis that is parallel to the longitudinal axis of the base to move the base between the respective cleaning conditions.

An embodiment provides the advantage that as the base may be rotated without rotating the entire body of the nozzle, a valve mechanism is not required to block the cleaning side that is not acting on the surface and less force is required to rotate the base between the first and second cleaning conditions.

The base may be rotatable in the body, and at least one cleaning side may be covered by the base when another cleaning side is exposed to act on a surface. Therefore, the at least one cleaning side is protected from wear when the other side is exposed on the surface, and if debris has accumulated on the at least one cleaning side, it is prevented from being deposited onto the surface.

In one embodiment, the nozzle comprises three or more side(s) to act on a surface in three or more cleaning condition (s). In such an embodiment, the first, second and third or more cleaning sides may each be optimized for use on a different type of surface and the user may rotate the base between the first, second and third or more cleaning conditions to select the cleaning side that is the most appropriate for cleaning said surface.

In one embodiment, the body comprises a suction chamber and the base encloses one side of the suction chamber when the base is in one of the cleaning conditions.

In one such an embodiment, the at least one cleaning side that is not acting on the surface may be subjected to suction in the suction chamber so that any debris that has accumulated on the one of that cleaning side may be removed by the suction. The base may comprise a first base outlet that through which air may be sucked out of the base to enter the suction chamber when the base is in a first cleaning condition, and a second base outlet through which air may be sucked out of the base to enter the suction chamber when the base is in a second cleaning condition. Since air may be sucked out of alternate base outlets depending on which cleaning side faces the surface, a valve mechanism is not required to block the suction outlet that is not in use.

In one embodiment, a suction passage is formed through the base to communicate the suction chamber with outside the body. The suction vent allows for air and debris to be drawn through the base and into the nozzle. The suction vent may extend through the base between the or at least two of the cleaning sides. In one embodiment, the first and second base outlets comprise distal ends of the suction passage.

In an alternate embodiment, a first suction passage is formed through the base to communicate the suction chamber with outside the body when the base is in the first cleaning condition and a second suction passage is formed through the base to communicate the suction chamber with outside the body when the base is in the second cleaning condition.

In one embodiment, the base is a plate and the first cleaning side is formed on one side of the plate and the second cleaning side is formed on the other side of the plate. The nozzle may comprise a locking unit configured to lock the base in each cleaning condition. A locking unit prevents unintentional rotation of the base relative to the body. In one such embodiment, the locking unit comprises a pair of locking members that are disposed on the body and are configured so that when suction is applied to the nozzle the base is urged against the locking members to prevent rotation of the base relative to the body. The locking members therefore prevent rotation of the base relative to the body when a vacuum cleaner attached to the nozzle is switched on. In an alternate embodiment, the locking unit comprises a biasing member and a locking pin that is received in the body and is slidable between a locked position wherein the base is prevented from rotating relative to the body and an unlocked position wherein the base is free to rotate, wherein the biasing member is configured to urge the locking pin into the locked position. Therefore, a user may selectively rotate the base by urging the locking pin into the unlocked position. The biasing member ensures that the locking pin returns to the locked position when it is released by the user.

The nozzle may comprise a lever arm that is configured to rotate the base upon actuation by a user. In one embodiment, the lever arm is fixed relative to the base. The lever arm enables the user to rotate the base relative to the body without directly touching the base so that the user does not need to touch any debris accumulated on the base.

In one embodiment, the first cleaning side is configured for use on a hard surface and the second cleaning side is configured for use on a soft surface. This allows for the nozzle to be optimized for use on both soft and hard surfaces so that the user may rotate the base into the first condition to clean hard surfaces and into the second condition to clean soft surfaces.

In one embodiment, at least a portion of the body comprises a transparent material. This allows for the user to see which cleaning condition the base is in.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
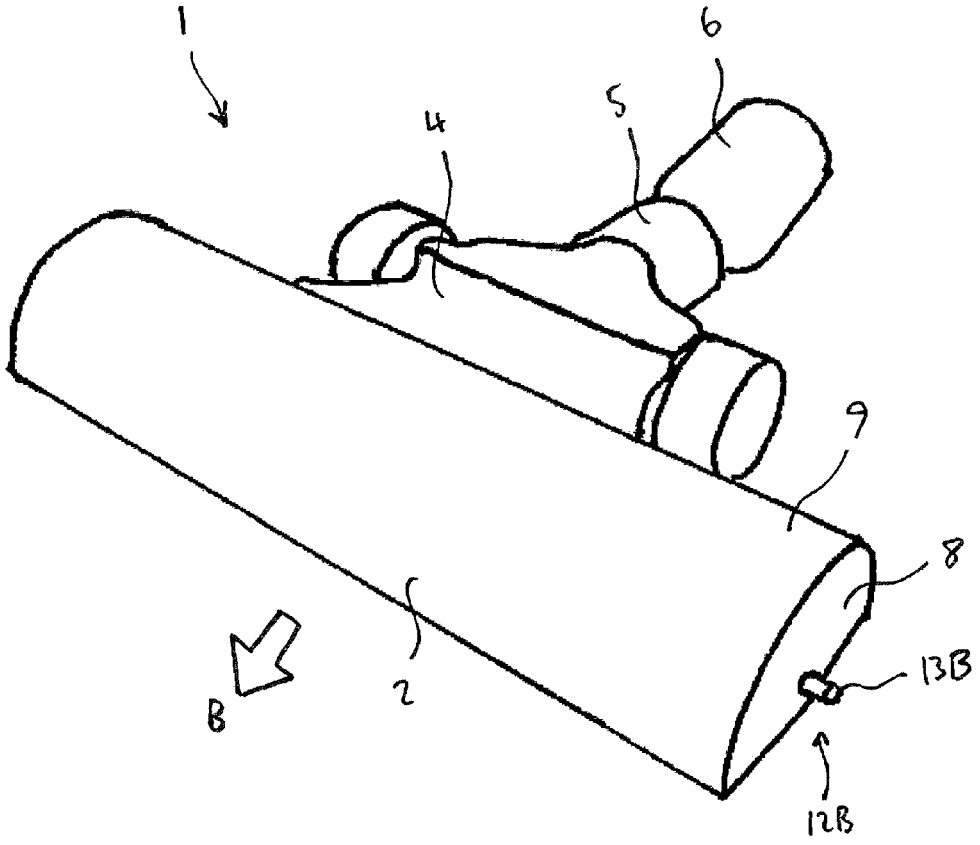
FIG. 1 shows a perspective view of a nozzle of a first embodiment of the invention.
Figure 2:
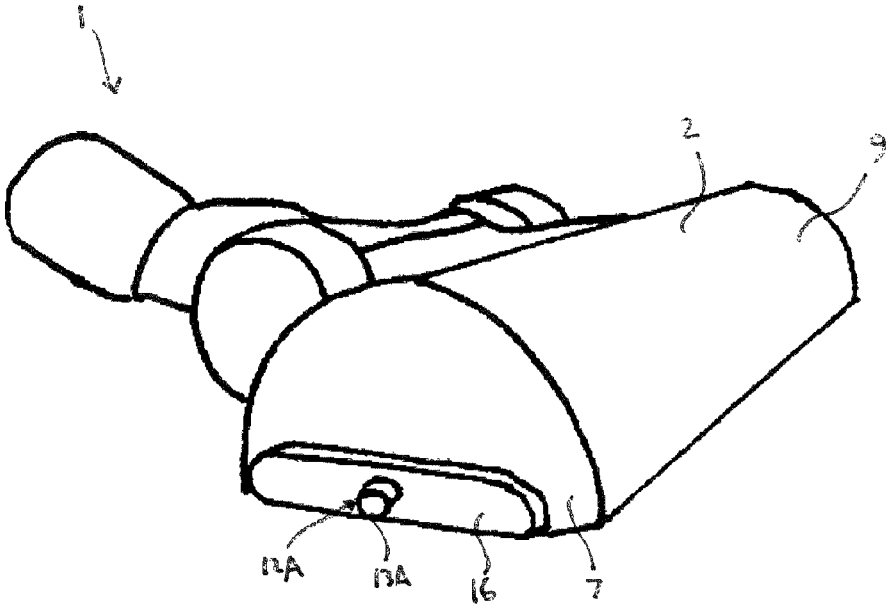
FIG. 2 shows a second perspective view of the nozzle of FIG. 1.
Figure 3:
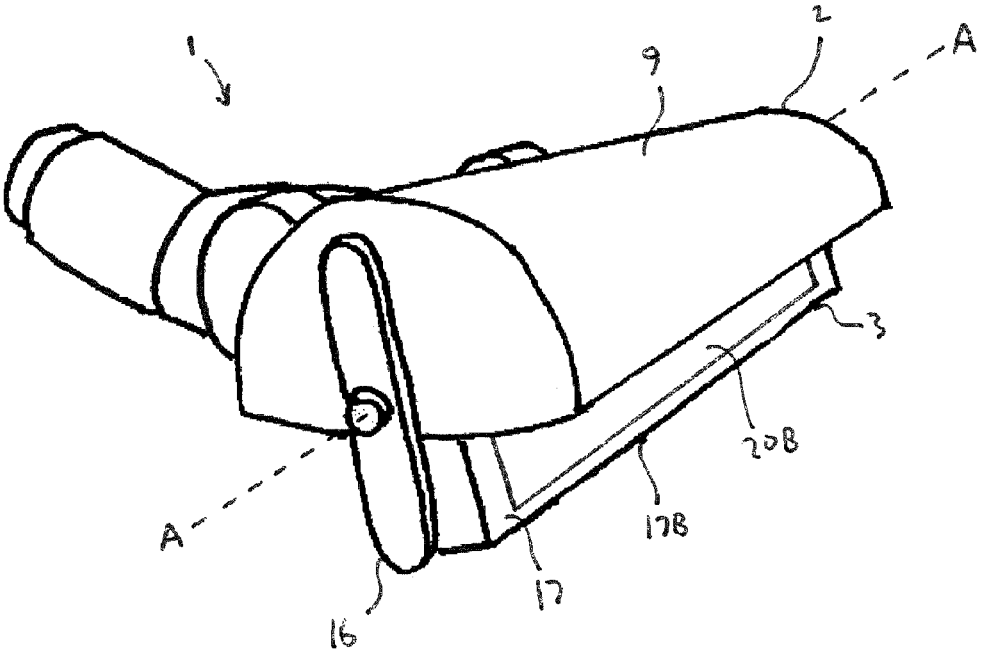
FIG. 3 shows a perspective view of the nozzle of FIG. 1, with a base rotated between first and second positions.
Figure 4:
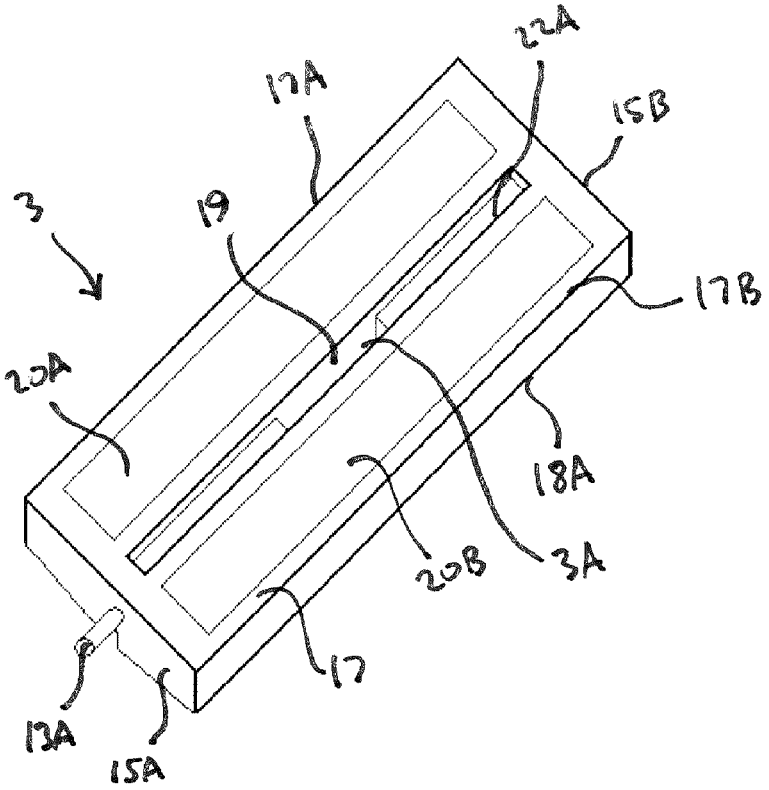
FIG. 4 shows a perspective view of the base of the nozzle of FIG. 1.
Figure 5:
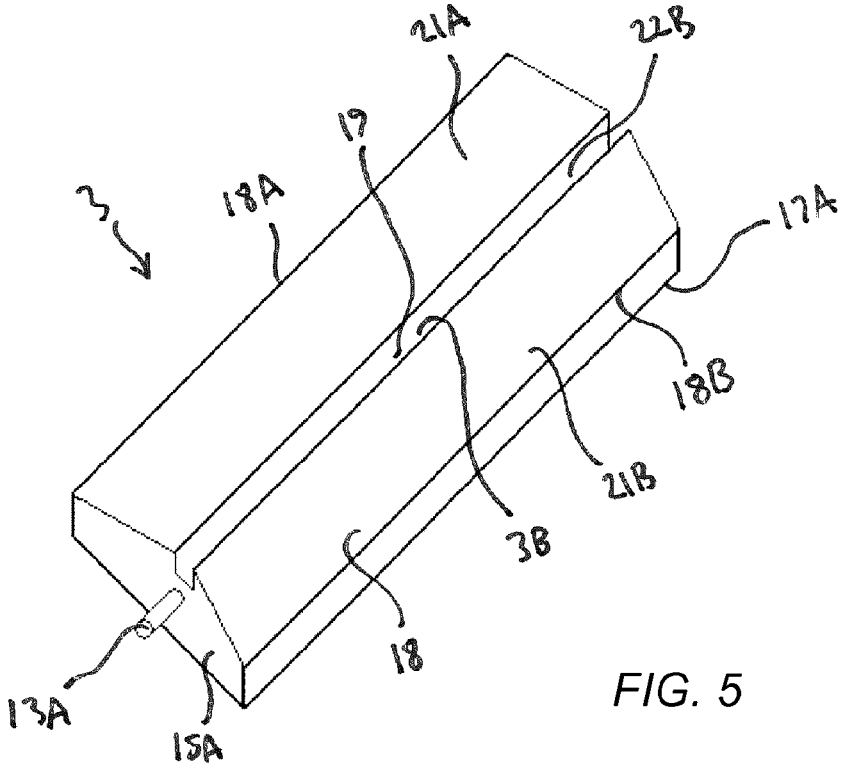
FIG. 5 shows a second perspective view of the base of the nozzle of FIG. 1.

Referring now to FIGS. 1-5, a nozzle 1 for a vacuum cleaner according to a first embodiment of the present invention is shown. The nozzle 1 comprises a body 2 and a base 3, which in the current embodiment is a soleplate. A duct 4 extends from the body 2 and is in fluid communication with a port 5. A rigid tubular conduit 6 extends from the port 5 and may be fluidly connected to a vacuum cleaner (not shown).

The body 2 comprises opposing first and second side walls 7, 8. A top wall 9 of the body 2 extends between the side walls 7, 8. The top wall 9 is curved so that the body 2 has a generally semi-circular shaped cross-section when viewed in the direction of either side wall 7, 8.

The body 2 has a bottom 10 that is disposed proximate the surface being vacuumed when the nozzle 1 is in use. A recess 11 extends into the bottom 10 of the body 2 and is disposed between the side walls 7, 8 and the top wall 9 of the body 2. The recess 11 is configured to receive the base 3 so that the base 3 is parallel to the bottom 10 of the body 2. The base 3 encloses one side of the recess 11 to form a suction chamber (not shown) that is fluidly communicated with the port 5 by the duct 4.

The base 3 is rotatably mounted to the body 2 by first and second pivot couplings 12A, 12B. The first and second pivot couplings 12A, 12B comprise first and second pivot pins 13A, 13B respectively. The pivot pins 13A, 13B are disposed in the center of opposite side ends 15A, 15B of the base 3. The first and second pivot pins 13A, 13B extend towards the first and second side walls 7, 8 of the body 2 respectively.

The first and second pivot couplings 12A, 12B further comprise first and second pivot apertures (not shown) that are provided in the first and second side walls 7, 8 respectively. The pivot apertures are configured to each receive a pivot pin 13A, 13B so that the base 3 is held between the side walls 7, 8 of the body 2 and is rotatable about the pivot pins 13A, 13B. Thus, the base 3 is rotatable relative to the body 2 about a rotational axis A-A (shown in FIG. 3). The first pivot pin 13A extends through the first side wall 7 of the body 2 so that it protrudes from the outer surface of the first side wall 7.

An actuation mechanism comprising a lever arm 16 is mounted to the portion of the first pivot pin 13A that protrudes from the first side wall 7. The first pivot pin 13A is fixed relative to the lever arm 16 and the base 3 and therefore the base 3 may be rotated relative to the body 2 by rotating the lever arm 16.

The base 3 has opposing major surfaces that comprise first and second base sides 17, 18. The base 3 is rotatable between a first position and a second position. When the base 3 is in the first position, the first base side 17 faces away from the top wall 9 of the body 2 so that the first base side 17 faces towards the surface being vacuumed when the nozzle 1 is in use. When the base 3 is in the second position, the base 3 is rotated 180 degrees from its first position about rotational axis A-A so that the first base side 17 faces towards the top wall 9 of the body 2 and the second base side 18 faces towards the surface being vacuumed.

The first and second base sides 17, 18 each comprise a leading edge 17A, 18A and a trailing edge 17B, 18B. The leading and trailing edges 17A, 17B, 18A, 18B of the first and second base sides 17, 18 are parallel to the rotational axis A-A of the base 3.

The leading edge 17A of the first base side 17 is remote of the rigid tubular conduit 6 when the base 3 is in the first position, and is normally forward-facing when the user pushes the nozzle 1 in a direction away from them (as shown by arrow 'B' in FIG. 1). The trailing edge 17B of the first base side 17 comprises the edge of the first base side 17 that is opposite the leading edge 17A. The leading edge 18A of the second base side 18 is remote of the rigid tubular conduit 6 when the base 3 is in the second position. The trailing edge 18B of the second base side 18 is opposite the leading edge 18A. The first and second base sides 17, 18 comprise first and second grooves 22A, 22B respectively that each extend longitudinally between the side ends 15A, 15B of the base 3 so that they each have a longitudinal axis that is parallel to the leading and trailing edges 17A, 17B, 18A, 18B of the first and second base sides 17, 18.

A suction slot 19 is provided in the base 3 and comprises an aperture that extends from the first groove 22A to the second groove 22B to fluidly communicate the first and second base sides 17, 18. The suction slot 19 extends longitudinally between the side ends 15A, 15B of the base 3 so that it has a longitudinal axis that is parallel to the leading edges 17A, 18A and trailing edges 17B, 18B of the first and second base sides 17, 18. The suction slot 19 is fluidly communicated with the duct 4, port 5 and rigid tubular conduit 6 by the recess 11 in the body 2 that forms the suction chamber. The portion of the suction slot 19 proximate the first base side 17 forms a first base outlet 3A and the portion of the suction slot 19 at the second base side 18 forms a second base outlet 3B. The length of the suction slot 19 may be less than the length of the first and second grooves 22A, 22B so that the cross-sectional area of the suction slot 19 is relatively small and therefore the velocity of the air that is sucked into the suction slot 19 is relatively large to improve the ability of the nozzle 1 to remove dirt and debris from the surface being cleaned.

The first base side 17 is configured for use on hard surfaces, for example, wooden laminate or tiled floors. The first base side 17 comprises first and second soft brushes 20A, 20B that each abut the surface being vacuumed when the base 3 is in the first position and the nozzle 1 is in use. The first soft brush 20A is disposed between the suction slot 19 and the leading edge 17A of the first base side 17. The second soft brush 20B is disposed between the suction slot 19 and the trailing edge 17B of the first base side 17.

The soft brushes 20A, 20B space the body 2 from a hard surface being vacuumed to prevent damage to the hard surface when the nozzle 1 is moved across the surface by the user. When the base 3 is in the first position, the bristles of the soft brushes 20A, 20B protrude from the bottom 10 of the body 2 so that a gap is provided between the surface being vacuumed and the leading edge 17A of the first base side 17. Therefore, debris, for example, sand and dirt particles, may be sucked through the gap between the leading edge 17A and the surface being vacuumed to enter the first groove 22A and then be sucked through the suction slot 19. This prevents debris from being pushed across the surface by the body 2 or base 3, without entering under the nozzle 1 to be sucked into the first groove 22A, when the nozzle 1 is moved across the hard surface by the user. The soft brushes 20A, 20B also help to dislodge debris that is stuck to the surface being vacuumed.

The second base side 18 is configured for use on soft surfaces, for example, carpeted floors and upholstery. The second base side 18 comprises first and second longitudinal glide elements 21A, 21B.

The first glide element 21A extends from the leading edge 18A of the second base side 18 and extends to the second groove 22B. The second glide element 21B extends from the trailing edge 18B of the second base side 18 and extends to the second groove 22B. The first and second glide elements 21A, 21B traverse the base 3 between the side ends 15A, 15B of the base 3. The first and second glide elements 21A, 21B protrude from the bottom 10 of the body 2 when the base 3 is in the second position so that they abut the soft surface being vacuumed and have a smooth finish to reduce friction between the base 3 and the soft surface being vacuumed so that the user may easily maneuver the nozzle 1 over the soft surface.

The first glide element 21A is angled away from the suction slot 19 so that the portion of the first guide element 21A that is proximate to the second groove 22B extends further from the bottom 10 of the body 2 than the portion of the first guide element 21A at the leading edge 18A of the second base side 18. The second glide element 21B is angled away from the suction slot 19 in the opposite direction to the first glide element 21A so that the portion of the second guide element 21B that is proximate to the second groove 22B extends further from the bottom 10 of the body 2 than the portion at the trailing edge 18B of the second base side 18. Therefore, a gap is provided between the surface being vacuumed and the leading and trailing edges 18A, 18B of the second base side 18 when the base 3 is in the second position so that the user may slide the nozzle 1 over larger debris to position the debris under the second groove 22B so that it may be sucked through the suction slot 19. For example, if the nozzle 1 is moved in the forward direction 'B', the gap between the leading edge 18A of the second base side 18 and the surface being vacuumed will allow debris present in front of the nozzle 1 to move under the first guide element 21A.

The low friction finish of the first guide element 21A allows for the first guide element 21A to be moved over the debris until the debris is positioned under the second groove 22B, at which point the debris may be sucked through the suction slot 19. The second guide element 21B allows for debris to be collected in a similar manner when the nozzle 1 is moved in a direction opposite to the forward direction 13'.

The second base side 18 may further comprise a lint remover for removing lint from the soft surface when the nozzle 1 is moved over the soft surface.

In use, the user rotates the base 3 into the first or second position, depending on which of the first and second base sides 17, 18 is more appropriate for use with the surface to be vacuumed.

The top wall 9 of the body 2 may be manufactured from a transparent material so that the user can see whether the base 3 is in the first or second positions without having to lift the nozzle 1 from the surface to be cleaned.

The user may rotate the base 3 between the first and second positions by lifting the nozzle 1 from the surface to be cleaned and then applying a force to the lever arm 16 to rotate the lever arm 16 so that the base 3 is urged to rotate about the rotational axis A-A. The user then positions the nozzle 1 so that the base 3 abuts the surface to be vacuumed and operates the vacuum cleaner (not shown) to apply suction to the nozzle 1, resulting in air and debris being drawn into the suction slot 19. For example, if the base 3 is in the first position then air and debris will be sucked into the first groove 22A, through the suction slot 19 and then out of the first base outlet 3A and into the suction chamber. Similarly, if the base 3 is in the second position then air and debris will be sucked into the second groove 22B, through the suction slot 19 and then out of the second base outlet 3B and into the suction chamber. When the user wishes to vacuum a different type of surface, the base 3 may be rotated accordingly in the manner previously described.

The first and second base sides 17, 18 are specialized for use with certain surface types, for example, certain floor types, and therefore will be more suitable for use with the surface types for which they are specialized than a nozzle that has one general purpose base side that is intended for use on all surface types. For example, some conventional nozzles (not shown) have a brush for use on hard surfaces that protrudes out of the base when the nozzle is used on hard surfaces and is retracted into the base using a lever mechanism when the nozzle is used on soft surfaces. In such an arrangement, the brush still takes up space on the side of the base when it is retracted and so the base would not be able to have the soft surface features of the second base side 18 described above, such as the first and second glide elements 21A, 21B that extend continuously from the leading and trailing edges 18A, 18B of the second base side 18 to the second groove 22B to provide smooth continuous contact surfaces that reduce friction between the nozzle 1 and the base 3 and permit the nozzle 1 to be easily moved over debris. Additionally, the lever mechanism that is used to retract the brush is complicated to manufacture and repair.

The relative rotational movement between the base 3 and the body 2 of the nozzle 1 allows for the base side 17, 18 that is not in use to be stowed inside the body 2 when the other base side 17, 18 is positioned for use. This prevents any debris that has accumulated on the base side 17, 18 that is not in use from being deposited on the surface being cleaned and also reduces the user's exposure to said debris, thereby improving hygiene.

Additionally, any debris that have accumulated on the base side 17, 18 that is not in use will be subjected to the low pressure in the recess 11 when the vacuum cleaner is switched on and so may be removed from said base side 17, 18. Furthermore, as the base 3 rotates relative to the body 2 and air is sucked out of alternate base outlets 3A, 3B depending on which base side 17, 18 faces the surface being vacuumed, none of the body 2, duct 4, port 5, rigid tubular conduit 6 or components that fluidly connect the rigid tubular conduit 6 to the vacuum cleaner are moved relative to each other to change which base side 17, 18 faces the surface to be cleaned. Therefore, the body 2, duct 4, port 5 and rigid tubular conduit 6 are subjected to less wear, and so are more likely to remain airtight to maintain suction and efficiency of the nozzle 1 and vacuum cleaner, over systems wherein the entire body is rotated to change which base side faces the surface to be cleaned. Additionally, systems wherein base sides are provided on alternate sides of the body and the body is rotated to change which base side faces the surface to be cleaned, with air being sucked out of the same base outlet regardless of which base side faces the surface being vacuumed, require a valve mechanism to prevent air being sucked through the base side that is not in use. This valve mechanism may be expensive, difficult to manufacture and may become blocked with debris during use. Furthermore, the valve mechanism may require the flow of air through the nozzle to sharply change direction by 90 degrees, which can increase the flow resistance through the nozzle and therefore reduce the efficiency of the nozzle and increase the noise generated as air is sucked through the nozzle.

A seal (not shown) is provided around the periphery of the base 3 and comprises a portion of resilient impermeable material, for example, rubber. When the base 3 is in the first or second positions, the seal abuts the portion of the body 2 around the periphery of the base 3 to prevent the ingress of air between the base 3 and the body 2. Therefore, the velocity of air flowing through the suction slot 19 is increased and so the suction power of the nozzle 1 is improved.

Additionally, the friction between the seal and the body 2 prevents the base 3 from being unintentionally rotated during use. A pair of apertures or gaps (not shown) is provided in the seal and each aligns with one of the pivot apertures in the side walls 7, 8 so that the pivot apertures may receive the pivot pins 13A, 13B of the pivot couplings 12A, 12B. In an alternate embodiment, the seal does not comprise apertures or gaps and is instead offset from the center of the base 3 towards one of the first and second base sides 17, 18 so that the pivot apertures are not blocked by the seal. Alternatively, the seal may be provided on the body 2 so that it seals against the base 3 when the base 3 is in the first or second positions. In yet another embodiment, the seal is omitted and instead the base 3 and the body 2 fit tightly to each other when the base 3 is in the first or second positions. In one such embodiment, a portion of the body 2 and/or base 3 is manufactured from a resilient material and abuts the other of the body 2 and/or base 3 when the base 3 is in the first and second positions.

Although in the above described embodiment the suction slot 19 is formed through the base 3, it should be recognized that a suction slot may instead be formed between the body 2 and an edge of the base 3.

Referring now to FIGS. 6-9, a nozzle 30 for a vacuum cleaner according to a second embodiment of the present invention is shown. The nozzle 30 of the second embodiment of the invention is similar to the nozzle 1 of the first embodiment of the invention, with like features retaining the same reference numerals. A difference is that the nozzle 30 of the second embodiment of the invention comprises a locking mechanism 31 that prevents the base 3 from being unintentionally rotated relative to the body 2 of the nozzle 30.

The locking mechanism 31 comprises first and second locking notches 32A, 32B and a locking pin 33. The locking pin 33 is received in an aperture (not shown) that extends through the lever arm 16. The locking pin 33 is slidable relative to the locking arm 16 in directions towards and away from the first side wall 7.

The first locking notch 32A is disposed on the outer surface of the first side wall 7, on the side of the rotational axis A-A that is remote from the duct 4. The first locking notch 32A is positioned so that when the base 3 is in the first position and the locking pin 33 is slid towards the first side wall 7, the locking pin 33 is received in the first locking notch 32A to prevent the base 3 from being rotated relative to the body 2. The second locking notch 32B is disposed on the outer surface of the first side wall 7, on the side of the rotational axis A-A that is proximate to the duct 4.

Figure 6:
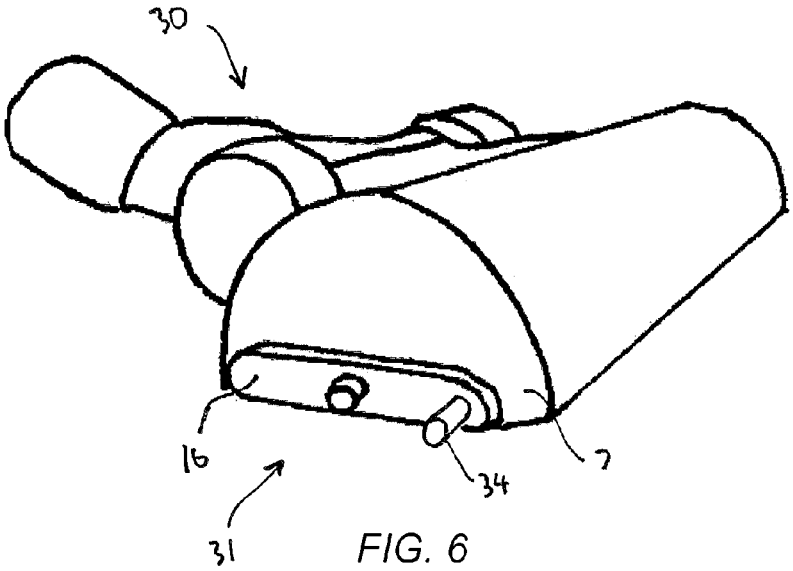
FIG. 6 shows a perspective view of a nozzle of a second embodiment of the invention.
Figure 7:
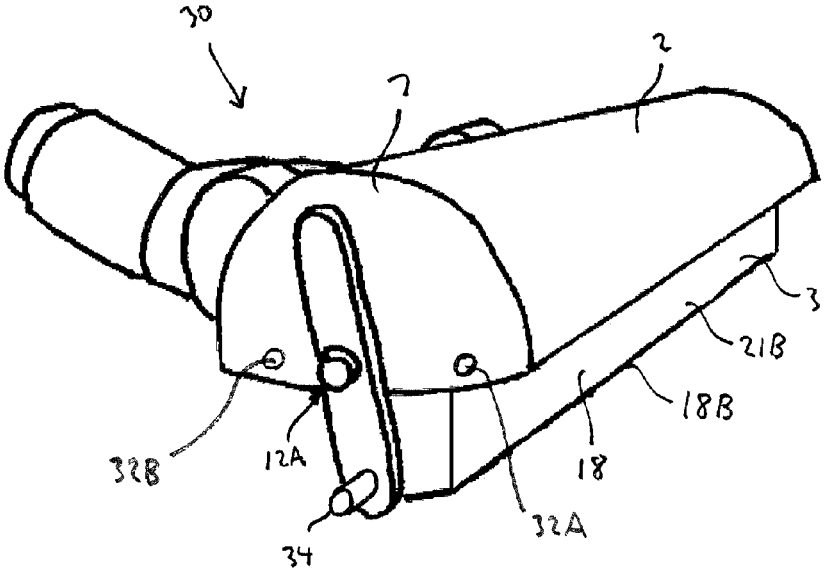
FIG. 7 shows a perspective view of the nozzle of FIG. 6, with a base rotated between first and second positions.
Figure 8:
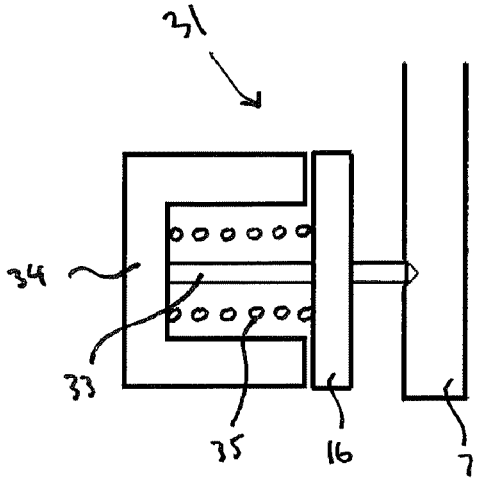
FIG. 8 shows a cross-sectional front view of a locking mechanism of the nozzle of FIG. 6, in an engaged position.
Figure 9:
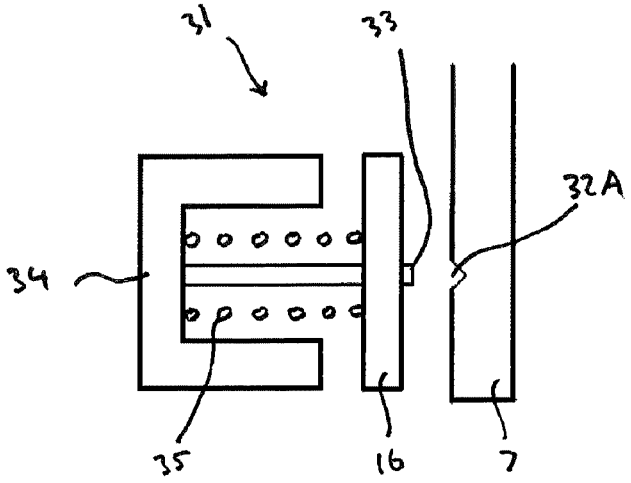
FIG. 9 shows a cross-sectional front view of the locking mechanism of the nozzle of FIG. 6, in a disengaged position.

The first and second locking notches 32A, 32B are equally spaced from the rotational axis A-A. The second locking notch 32B is positioned so that when the base 3 is in the second position and the locking pin 33 is slid towards the first side wall 7, the locking pin 33 is received in the second locking notch 32B to prevent the base 3 from being rotated relative to the body 2. Therefore, the locking pin 33 is slidable from an engaged position, wherein the locking pin 33 is received in one of the locking notches 32A, 32B so that the base 3 is prevented from rotating relative to the body 2 (as shown in FIGS. 6 and 8), and a disengaged position, wherein the locking pin 33 does not extend into either of the locking notches 32A, 32B so that the base 3 is free to rotate relative to the body 2 (as shown in FIGS. 7 and 9).

An end cap 34 is provided on the end of the locking pin 33 that is remote to the first side wall 7. A biasing member 35, for example, a spring or portion of resilient material, is provided between the end cap 34 and the lever arm 16. The biasing member 35 is configured so that it is under tension when the end cap 34 is spaced from the lever arm 16. Therefore, the end cap 34 is urged towards the lever arm 16 and thus the locking pin 33 is urged towards the first side wall 7 of the body 2 so that the locking pin 33 is urged into one of the locking notches 32A, 32B when the base 3 is in the first and second positions.

In use, when the user wishes to rotate the base 3 relative to the body 2, they must first slide the locking pin 33 into the disengaged position. For example, if the base 3 is in the first position, the user grips the end cap 34 and pulls the end cap 34 away from the lever arm 16. This will cause the locking pin 33 to be urged out of the first locking notch 32A, against the force of the biasing member 35. The user may then rotate the base 3 by rotating the lever arm 16. When the base 3 has been rotated to the second position, the user releases the end cap 34 and the biasing member 35 will urge the locking pin 33 into the engaged position so that it is received in the second locking notch 32B and the base 3 is prevented from rotating relative to the body 2.

Referring now to FIGS. 10-13, a nozzle 40 for a vacuum cleaner according to a third embodiment of the present invention is shown. The nozzle 40 of the third embodiment of the invention is similar to the nozzle 1 of the first embodiment of the invention, with like features retaining the same reference numerals. A difference is that the nozzle 40 of the third embodiment of the invention comprises a locking mechanism 41 that prevents the base 3 from being unintentionally rotated relative to the body 2 of the nozzle 40. Another difference is that the first and second pivot couplings 12A, 12B of the first embodiment of the invention are omitted and are replaced with alternative first and second pivot couplings 43A.

The locking mechanism 41 comprises first and second locking members 42A, 42B. The first and second locking members 42A, 42B are disposed on the inside surface of the top wall 9 of the body 2 so that the locking members 42A, 42B protrude into the recess 11. The first locking member 42A is positioned on a portion of the top wall 9 that is remote of the duct 4 and is close to, but spaced from, the bottom 10 of the body 2. The second locking member 42B is positioned on a portion of the top wall 9 that is proximate to the duct 4 and is close to, but spaced from, the bottom 10 of the body 2. The first and second locking members 42A, 42B are spaced from the bottom 10 by the same distance.

The base 3 is rotatably mounted to the body 2 by the first and second pivot couplings 43A. The first and second pivot couplings 43A comprise first and second pivot pins 44A respectively. The pivot pins 44A are disposed in the center of opposite side ends 15A, 15B of the base 3. The first and second pivot pins 44A extend towards the first and second side walls 7, 8 of the body 2 respectively.

The first and second pivot couplings 43A further comprise first and second pivot apertures 45A that are provided in the first and second side walls 7, 8 respectively. The pivot apertures 45A are configured to each receive a pivot pin 44A so that the base 3 is held between the side walls 7, 8 of the body 2 and is rotatable about the pivot pins 44A. The first pivot pin 44A extends through the first side wall 7 of the body 2 so that it protrudes from the outer surface of the first side wall 7.

A lever arm (not shown) is mounted to the portion of the first pivot pin 44A that protrudes from the first side wall 7. The first pivot pin 44A is fixed relative to the lever arm and the base 3 so that when the lever arm is rotated by the user the base 3 also rotates.

Figure 10:
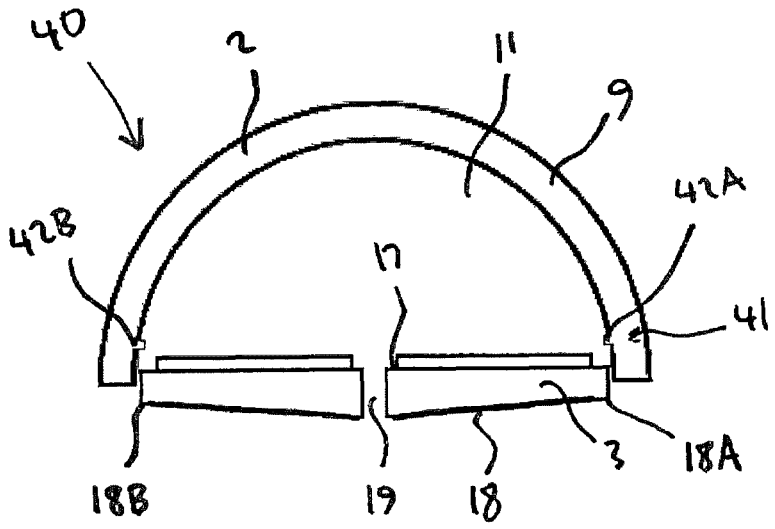
FIG. 10 shows a cross-sectional side view of a body and base of a nozzle of a third embodiment of the invention, with the base in an unlocked position.
Figure 11:
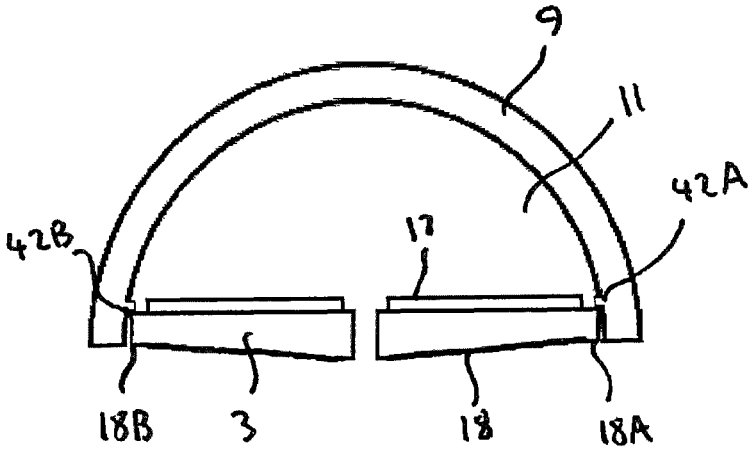
FIG. 11 shows a cross-sectional side view of the body and base of the nozzle of FIG. 10, with the base in a locked position.
Figure 12:
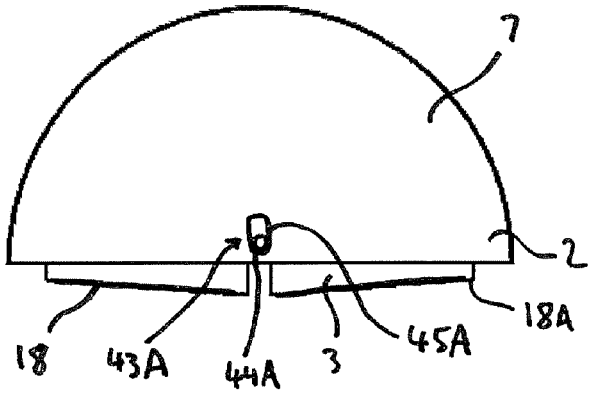
FIG. 12 shows a side view of the body and base of the nozzle of FIG. 10, with the base in the unlocked position.
Figure 13:
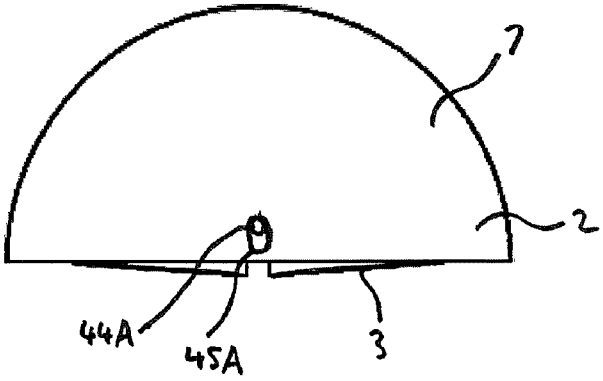
FIG. 13 shows a side view of the body and base of the nozzle of FIG. 10, with the base in the locked position.

The first and second pivot apertures 45A are slot shaped and extend longitudinally in a direction away from the bottom 10 of the body 2. Therefore, when the nozzle 40 is in use, the pivot apertures 45A extend perpendicularly to the surface being vacuumed. The first and second pivot pins 44A are slidably received in the first and second pivot apertures 45A so that the base 3 may be slid relative to the body 2 between an unlocked position (as shown in FIGS. 10 and 12) and a locked position (as shown in FIGS. 11 and 13).

When the base 3 is in the unlocked position, the first and second pivot pins 44A are received in a portion of the first and second pivot apertures 45A respectively that is proximate to the bottom 10 of the body 2. In the unlocked position, the base 3 is spaced from the first and second locking members 42A, 42B so that the base 3 may be rotated relative to the body 2 by rotating the lever arm. When the base 3 is in the locked position, the first and second pivot pins 44A are received in a portion of the first and second pivot apertures 45A respectively that is remote to the bottom 10 of the body 2. In the locked position, the base 3 abuts the first and second locking members 42A, 42B so that the base 3 is prevented from rotating relative to the body 2.

In use, the user positions the nozzle 40 so that the base 3 abuts the surface to be vacuumed and operates the vacuum cleaner (not shown) to apply suction to the nozzle 40, resulting in a low pressure in the recess 11 of the body 2 that causes air and debris to be drawn into the nozzle 40 through the suction slot 19. The low pressure in the recess 11 will urge the base 3 to slide into the recess 11 so that the base 3 is biased into its locked position wherein it abuts the first and second locking members 42A, 42B. Therefore, when suction is applied to the nozzle 40, the base 3 is prevented from being rotated between its first and second rotational positions so that unintentional rotation of the base 3 is prevented when the nozzle 40 is maneuvered by the user.

To rotate the base 3 between the first and second rotational positions, the user must first switch off the vacuum cleaner so that no suction is applied to the nozzle 40. This will result in the base 3 no longer being urged into the locked position. The user may then slide the base 3 into the unlocked position by holding the nozzle 40 away from the floor with the bottom 10 of the body 2 facing towards the floor so that the base 3 is urged into the unlocked position under the force of gravity.

In an alternative embodiment (not shown), the base 3 is biased into the unlocked position by a biasing means, for example, a spring or portion of resilient material, that is disposed in the first and/or the second locking aperture 45A. In such an embodiment, the force that biasing means exerts on the base 3 to urge the base into the unlocked position is less that the force that the suction exerts on the base 3 when the vacuum cleaner is switched on.

When the base 3 is slid into the unlocked position, the user may rotate the base 3 between the first and second rotational positions by rotating the lever arm. The base 3 will be urged back into the locked position when the user switches on the vacuum cleaner to apply suction to the nozzle 40.

Figure 14:
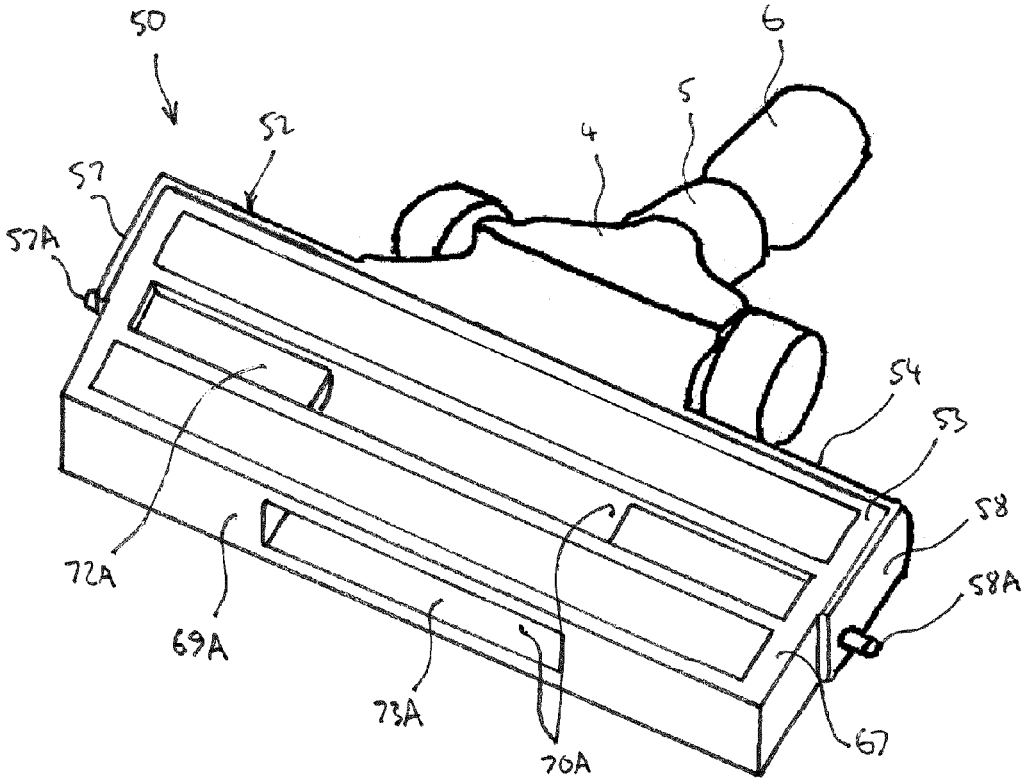
FIG. 14 shows a perspective view of a nozzle of a fourth embodiment of the invention.
Figure 15:
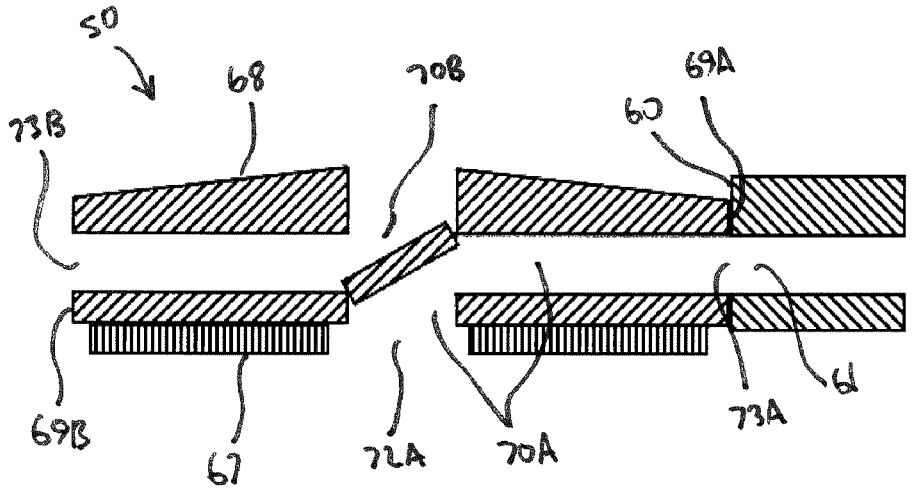
FIG. 15 shows a cross-sectional side view of the nozzle of FIG. 14, in a first position.
Figure 16:
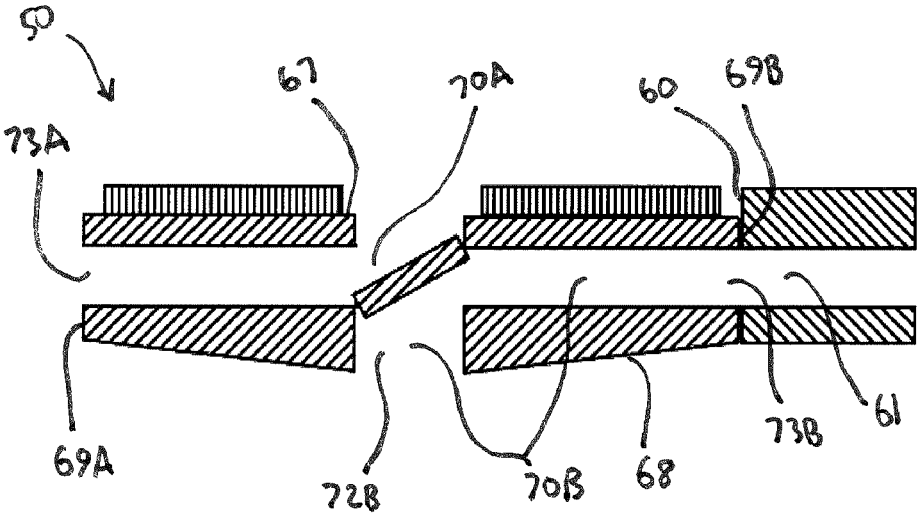
FIG. 16 shows a cross sectional side view of the nozzle of FIG. 14, in a second position; and, FIG. 17 shows a perspective view of a nozzle of a fifth embodiment of the invention.

Referring now to FIGS. 14-16, a nozzle 50 for a vacuum cleaner according to a fourth embodiment of the present invention is shown. The nozzle 50 of the fourth embodiment of the invention is similar to the nozzle 1 of the first embodiment of the invention, with like features retaining the same reference numerals. A difference is that the body 52 of the nozzle 50 of the fourth embodiment of the invention does not cover the base 53.

The body 52 comprises a housing 54 and first and second side members 57, 58. The first and second side members 57, 58 extend from opposing ends of the housing 54 so that the body 52 is generally U-shape when viewed from above. The base 53 is mounted between the first and second side members 57, 58 and is rotatably coupled thereto by first and second pivot couplings 57A, 58A so that the base 53 is rotatable relative to the body 52.

The housing 54 comprises a housing suction surface 60 that is perpendicular to the surface being vacuumed when the nozzle 50 is in use. An aperture 61 extends through the housing suction surface 60 and forms a suction chamber that is fluidly communicated with the port 5 by the duct 4. The suction chamber may be a space in the housing 54 that has a cross-sectional area that is larger than that of the duct 4 and/or port 5. Alternatively, the suction chamber may be any passage in the housing 54 that fluidly communicates the housing suction surface 60 with the duct 4 and port 5.

The base 53 has opposing major surfaces that comprise first and second base sides 67, 68. The base 53 is rotatable between a first position and a second position. When the base 53 is in the first position, the first base side 67 faces towards the surface being vacuumed when the nozzle 50 is in use. When the base 53 is in the second position, the base 53 is rotated 180 degrees from its first position about the first and second pivot couplings 57A, 58A so that the first base side 67 faces away from the surface being vacuumed and the second base side 68 faces towards the surface being vacuumed. As with the first embodiment of the invention, the first and second base sides 67, 68 are configured for use on hard and soft surfaces respectively. The suction chamber is enclosed by the base 53 when the base 53 is in the first and second positions.

The first and second base sides 67, 68 comprise first and second grooves 72A, 72B respectively that each extend longitudinally between the first and second side members 57, 58 of the base 53 so that they each have a longitudinal axis that is parallel to the axis of rotation of the base 53.

The base 53 has first and second end surfaces 69A, 69B that are perpendicular to the first and second base sides 67, 68. The first and second end surfaces 69A, 69B extend between the first and second base sides 67, 68, on opposite sides of the base 53.

A first suction passage 70A extends into the first end surface 69A in a direction perpendicular to the first end surface 69A and extends through the base 53 to the first groove 72A that is formed in the first base surface 67. The portion of the first suction passage 70A that extends into the first end surface 69A forms a first base outlet 73A. The first suction passage 70A fluidly communicates the first base outlet 73A with the first groove 72A. A second suction passage 70B extends into the second end surface 69B in a direction perpendicular to the second end surface 69B and extends through the base 53 to the second groove 72B that is formed in the second base surface 68. The portion of the second suction passage 70B that extends into the second end surface 69B forms a second base outlet 73B. The second suction passage 70B fluidly communicates the second base outlet 73B with the second groove 72B.

In use, the user rotates the base 53 into the first or second position, depending on which of the first and second base sides 67, 68 is more appropriate for use with the surface to be vacuumed. When the base 53 is in the first position, the first end surface 69A faces the housing suction surface 60 so that the first base outlet 73A is fluidly communicated with the suction chamber. Therefore, debris may be sucked into the first groove 72A, through the first suction passage 70A and into the suction chamber where it is then sucked into the vacuum cleaner via the port 5 and rigid tubular conduit 6. When the base 53 is in the second position, the second end surface 69B faces the housing suction surface 60 so that the second base outlet 73B is fluidly communicated with the suction chamber. Therefore, debris may be sucked into the second groove 72B, through the second suction passage 70B and into the suction chamber where it is then sucked into the vacuum cleaner via the port 5 and rigid tubular conduit 6.

Since the base 53 rotates relative to the body 52 and air is sucked out of alternate base outlets 73A, 73B depending on which base side 67, 68 faces the surface being vacuumed, none of the body 52, duct 4, port 5, rigid tubular conduit 6 or any components (not shown) that fluidly communicate the rigid tubular conduit 6 with the vacuum cleaner are moved relative to each other to change which base side 67, 68 faces the surface to be cleaned. Therefore, the body 52, duct 4, port 5 and rigid tubular conduit 6 are subjected to less wear, and so are more likely to remain airtight to maintain suction and efficiency of the nozzle 50 and vacuum cleaner, over systems wherein the entire body is rotated to change which base side faces the surface to be cleaned. Additionally, systems wherein base sides are provided on alternate sides of the body and the body is rotated to change which base side faces the surface to be cleaned, with air being sucked out of the same base outlet regardless of which base side faces the surface being vacuumed, require a valve mechanism to prevent air being sucked through the base side that is not in use. This valve mechanism may be expensive, difficult to manufacture and may become blocked with debris during use. Furthermore, the valve mechanism may require the flow of air through the nozzle to sharply change direction by 90 degrees, which can increase the flow resistance through the nozzle and therefore reduce the efficiency of the nozzle and increase the noise generated as air is sucked through the nozzle.

A seal (not shown) is provided on the housing suction surface 60 and surrounds the aperture 61 that extends into the housing suction surface 60. The seal comprises a portion of resilient impermeable material, for example, rubber. When the base 53 is in the first or second positions, the seal abuts the first or second base outlets 73A, 73B respectively to prevent the ingress of air between the base 53 and the housing 54 into the suction passage 70A, 70B that is fluidly communicated with the aperture 61. Therefore, the velocity of the air flowing through the base 53 is increased, in comparison to nozzles that do not comprise a seal, and so the suction power of the nozzle 50 is improved. Additionally, the friction between the seal and the body 52 prevents the base 53 from being unintentionally rotated during use.

In one embodiment, the edges of the base 53 wherein the first and second side ends 69A, 69B meet the first and second base sides 67, 68 are rounded or bevelled to facilitate rotation of the base 53 relative to the body 52.

Although in the above described embodiment the nozzle 50 comprises first and second suction passages 70A, 70B, in an alternate embodiment (not shown) the second suction passage 70B is omitted. In such an embodiment, the second base side is on an adjacent side of the base to the first base side so that the base sides are perpendicular. The first suction passage extends through the base to fluidly communicate the grooves of the first and second base sides. The first suction passage may follow a substantially right-angled path through the base. When the base is in the first position and the nozzle is in use, the first base side faces the surface being vacuumed and the second base side faces towards the housing suction surface so that the portion of the of the first suction passage at the second base side forms a base outlet that is fluidly communicated with the aperture in the housing. Thus, debris may be sucked into the groove in the first base side, through the first suction passage, and into the suction chamber in the body of the nozzle. To move the base into the second position, the user rotates the base 90 degrees from the first position so that the second base side faces away from the surface to be vacuumed. The user may then rotate the entire nozzle by 180 degrees so that when the nozzle is in use the second base side faces towards the surface being vacuumed. When the base is in the second position, the first base side faces towards the housing suction surface so that the portion of the first suction passage at the first base side forms a base outlet that is fluidly communicated with the aperture in the housing. Thus, debris may be sucked into the groove in the second base side, through the first suction passage, and into the suction chamber in the body of the nozzle.

Figure 17:
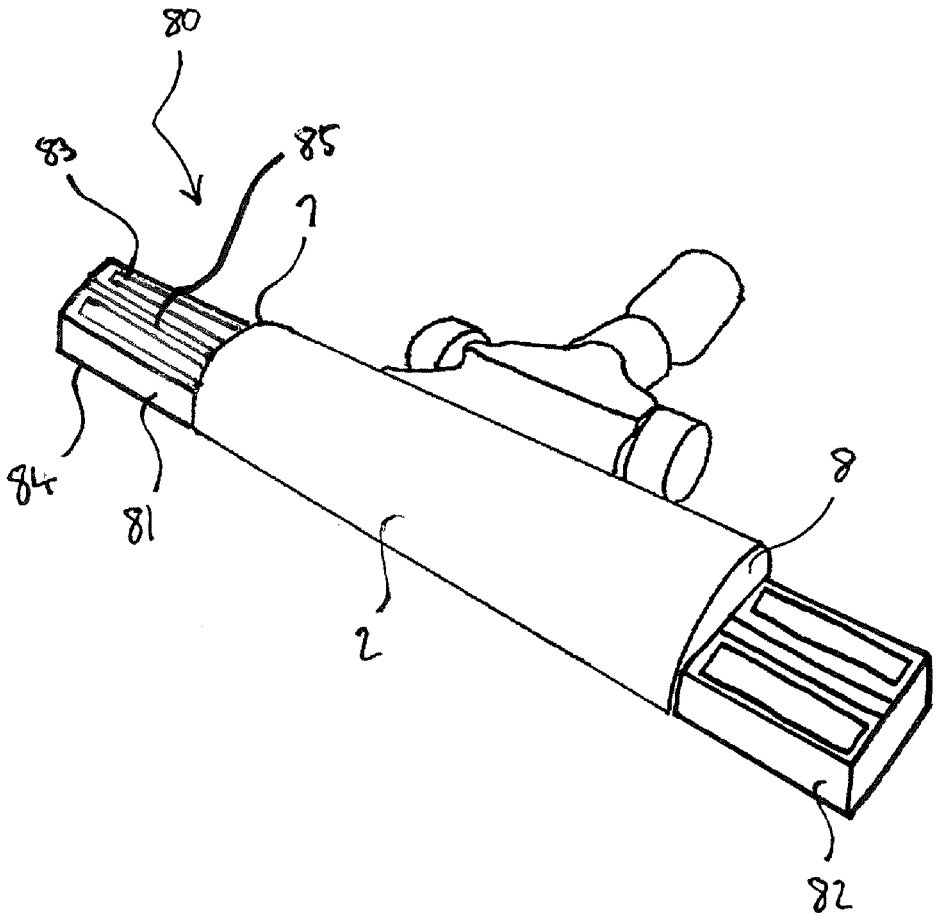

Referring now to FIG. 17, a nozzle 80 for a vacuum cleaner according to a fifth embodiment of the present invention is shown. The nozzle 80 of the fifth embodiment of the invention is similar to the nozzle 1 of the first embodiment of the invention, with like features retaining the same reference numerals. A difference is that the nozzle 80 of the fifth embodiment of the invention comprises first and second auxiliary cleaning members 81, 82. The first auxiliary member 81 is fixedly attached to the first pivot pin 13A on the opposite side of the first side wall 7 to the base 3 and the second auxiliary member 82 is fixedly attached to the second pivot pin 13B on the opposite side of the second side wall 8 to the base 3. Therefore, the base 3 and the first and second auxiliary cleaning members 81, 82 are fixed relative to each other and are rotatable relative to the body 2 of the nozzle 80.

The first and second auxiliary cleaning members 81 and 82 have similar features and so, for the sake of brevity, only one will be described in detail hereinafter. The first auxiliary cleaning member 81 comprises opposing major surfaces that comprise first and second sides 83, 84. The first and second sides 83, 84 of the first auxiliary cleaning member 81 are configured for use on hard and soft surfaces respectively, having features similar to the base sides 17, 18 of the nozzle 1 of the first embodiment of the invention. The first and second sides 83, 83 comprise a first groove 85 and a second groove (not shown) respectively. The first and second grooves 85 of the first auxiliary cleaning member 81 are coaxial with the first and second grooves 22A, 22B respectively of the base 3.

The base 3 and the first auxiliary cleaning member 81 are rotatable between a first position, wherein the first base side 17 and the first side 83 of the first auxiliary cleaning member 81 face towards the surface being vacuumed, and a second position, wherein the second base side 18 and the second side 84 of the first auxiliary cleaning member 81 face towards the surface being vacuumed. The first and second side walls 7, 8 of the base 3 each comprises an aperture (not shown) that is positioned between the rotational axis of the base 3 and the bottom 10 of the body 2. The aperture in the first side wall 7 fluidly communicates the first grooves 22A, 85 of the base 3 and first auxiliary cleaning member 81 when the base 3 is in the first position and fluidly communicates the second grooves 22B of the base 3 and the first auxiliary cleaning member 81 when the base 3 is in the second position. The reduced height of the first and second auxiliary cleaning members 81, 82 compared to the body 2 of the nozzle 80 allows for the first and second auxiliary cleaning members 81, 82 to be slid under objects that have a low clearance from the surface being vacuumed to clean under said objects, even if the clearance is less than the height of the body 2.

The first and second auxiliary cleaning members 81, 82 increase the surface area of the nozzle 1 that is in contact with the surface being vacuumed without increasing the size of the body 2. For example, soft brushes for use on hard surfaces may be provided on the first side 84 of each of the first and second auxiliary cleaning members 81, 82, to dislodge debris that is stuck to the surface being vacuumed, and the size of the body 2 does not need to be increased to cover the first and second auxiliary members 81, 82 because the grooves 85 in the auxiliary cleaning members 81, 82 are fluidly communicated with the suction chamber via the apertures in the first and second side walls 7, 8. Therefore, the size of the nozzle 80 during storage is reduced in comparison to an arrangement wherein the body covers the base and the auxiliary cleaning members.

Although in the above described embodiments the user rotates a lever arm 16 to rotate the base relative to the body 2, in an alternate embodiment (not shown) the lever arm 16 is omitted and is replaced by an electric motor that is mounted to one of the pivot pins 13A, 13B, 44A and is configured so that when the electric motor is actuated by a user the base 3, 53 is rotated relative to the body 2, 52. In yet another embodiment, the lever arm 16 is omitted and instead the base 3, 53 is rotated relative to the body 2, 52 by the user lifting the body 2, 52 and directly touching the base 3, 53 to apply a force thereto. In one embodiment (not shown), the lever arm 16 is coupled to the base 3, 53 by a series of gears that translate rotation of the lever arm 16 into rotation of the base 3, 53.

Although in the above described embodiments the base 3, 53 comprises a soleplate that is substantially planar and has two major surfaces that form the first and second base sides 17, 18, 67, 68, in alternate embodiments (not shown) the base has three or more major surfaces that are each designed for vacuuming a specific type of surface. In one such embodiment, the base comprises three major surfaces that form first, second and third base sides so that the base has a triangular cross-section when viewed in the direction of either of the side walls. The first, second and third base sides are each designed for use on different surface types. For example, the first and second base sides may be designed for use on hard and soft floors respectively, comprising the same features as the first and second base sides of the first embodiment of the invention, and the third base side is designed for use on a different hard or soft floor type, for example a different soft floor carpet type. In another embodiment, the third base side is designed to finish the hard floor/soft floor after vacuuming the floor using the first/second base side and comprises, for example, a soft fabric for polishing the hard floor or a lint remover for removing lint from the soft floor.

Although in the above described embodiments the first base side 17, 67 comprises first and second soft brushes 20A, 20B in alternate embodiments (not shown) one or both of the soft brushes 20A, 20B may be omitted and replaced with other features suitable for use on hard surfaces, for example, a soft fabric for polishing the hard surface when the first base side 17, 67 is moved across the surface. Similarly, although in the above described embodiments the second base side 18, 68 comprises first and second glide elements 21A, 21B, in alternate embodiments (not shown) the first and second glide elements 21A, 21B are omitted and are replaced with other features suitable for use on soft surfaces, such as, a carpet brush or a rotating brush that is powered by a motor.

In the above described embodiments the top wall 9 of the body 2 is curved. Such an arrangement allows for the body 2 to be made as small as possible whilst allowing for the base 3 to rotate relative to the body 2. However, it should be recognized that other shapes of body 2, for example, having a rectangular or semi-hexagonal cross-section, are intended to fall within the scope of the invention.

Although in the above described embodiment the pivot pins 13A, 13B, 44A are provided on the side walls 7, 8 or side members 57, 58 of the body 2, 52 and the pivot apertures are provided in the base 3, 53, in an alternate embodiment (not shown) the pivot pins are provided on the base and the pivot apertures are provided on the sides walls or side members of the body.

Although in the above described embodiment the base 3 is rotatably mounted to the body 2 in a manner so that the rotational axis A-A of the base 3 is perpendicular to the side walls 7, 8 of the body 2, in alternate embodiments (not shown) the base 3 may be mounted to the body 2 in a manner so that the rotational axis is in an alternate orientation, for example, parallel to the side walls 7, 8 of the body 2.

Although in the above described embodiments the leading and trailing edges 17A, 17B, 18A, 18B of the first and second base sides 17, 18, 67, 68 are parallel to the rotational axis A-A of the base 3, 53, in alternate embodiments (not shown) the leading and trailing edges may have an alternative arrangement, for example, the leading and trailing edges may be curved so that the base 3 is tapered towards the first and second base sides 17, 18.

Although in the above described embodiments the nozzle 1, 30, 40, 50, 80 comprises a single base 3, 53 that is rotatable relative to the body 2, 52, in alternate embodiments (not shown) the nozzle 1, 30, 40, 50, 80 may comprise a plurality of bases that are each rotatable relative to the body 2, 52 and may each comprise a first base side for use on hard surfaces and a second base side for use on soft surfaces.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A nozzle for a vacuum cleaner, the nozzle comprising:

a body, and a base having a longitudinal axis, and at least two cleaning sides configured to act on a surface in respective cleaning conditions, wherein the base is rotatable around a rotational axis (A-A) that is parallel to the longitudinal axis of the base to move the base between the respective cleaning conditions, wherein the body comprises a suction chamber and the base encloses one side of the suction chamber when the base is in one of the cleaning conditions, wherein the base comprises a first base outlet through which air may be sucked out of the base to enter the suction chamber when the base is in a first cleaning condition, and a second base outlet through which air may be sucked out of the base to enter the suction chamber when the base is in a second cleaning condition.

2. A nozzle according to claim 1, wherein the base is rotatable in the body.

3. A nozzle according to claim 1, wherein at least one cleaning side is covered by the body when another cleaning side is exposed to act on a surface.

4. A nozzle according claim 1, wherein a suction passage is formed through the base to communicate the suction chamber with outside the body and optionally extends through the base between the or at least two of the cleaning sides.

5. A nozzle according to claim 4, wherein the first and second base outlets comprise distal ends of the suction passage.

6. A nozzle according to claim 1, wherein a first suction passage is formed through the base to communicate the suction chamber with outside the body when the base is in the first cleaning condition and a second suction passage is formed through the base to communicate the suction chamber with outside the body when the base is in the second cleaning condition.

7. A nozzle according to claim 1, comprising three or more side(s) to act on a surface in three or more cleaning condition(s).

8. A nozzle according to claim 1, wherein the base is a plate and a first cleaning side is formed on one side of the plate and a second cleaning side is formed on the other side of the plate.

9. A nozzle according to claim 1, further comprising a locking unit configured to lock the base in each cleaning condition.

10. A nozzle according to claim 9, wherein the locking unit comprises a pair of locking members that are disposed on the body and are configured so that when suction is applied to the nozzle the base is urged against the locking members to prevent rotation of the base relative to the body.

11. A nozzle according to claim 9, wherein the locking unit comprises a biasing member and a locking pin that is received in the body and is slidable between a locked position wherein the base is prevented from rotating relative to the body and an unlocked position wherein the base is free to rotate, wherein the biasing member is configured to urge the locking pin into the locked position.

12. A vacuum cleaner comprising a nozzle according to claim 1.

* * * * *